United States Patent [19]

Jürgens

[11] 4,440,246

[45] Apr. 3, 1984

[54] CUTTING MEMBER FOR ROTARY DRILL BITS

[75] Inventor: Rainer Jürgens, Altencelle, Fed. Rep. of Germany

[73] Assignee: Christensen, Inc., Salt Lake City, Utah

[21] Appl. No.: 361,305

[22] Filed: Mar. 24, 1982

[30] Foreign Application Priority Data

Apr. 11, 1981 [DE] Fed. Rep. of Germany ..... 3114749

[51] Int. Cl.[3] ..... E21B 10/46

[52] U.S. Cl. ..... 175/329; 175/410

[58] Field of Search ..... 175/329, 330, 374, 375, 175/379, 409, 410, 411, 412, 413; 51/309, 307; 76/101 R, 101 A, 108 A, 108 R, DIG. 6, DIG. 12; 125/39, 36; 228/903, 263 A; 419/6, 18; 428/564, 565; 407/119

[56] References Cited

U.S. PATENT DOCUMENTS

| | | | |
|---|---|---|---|
| 1,887,372 | 11/1932 | Emmons | 175/411 |
| 2,053,977 | 9/1936 | Taylor | 407/119 |
| 3,938,599 | 2/1976 | Horn | 175/329 |
| 4,186,628 | 2/1980 | Bonnice | 76/108 A |
| 4,373,593 | 2/1983 | Phaal et al. | 175/410 |
| 4,376,553 | 3/1983 | Brewer et al. | 175/410 |

FOREIGN PATENT DOCUMENTS

| | | | |
|---|---|---|---|
| 2032979 | 5/1980 | United Kingdom | 175/409 |
| 300610 | 8/1971 | U.S.S.R. | 175/410 |

*Primary Examiner*—William F. Pate, III
*Assistant Examiner*—Hoang C. Dang
*Attorney, Agent, or Firm*—Rufus M. Franklin

[57] ABSTRACT

A cutting member for rotary drill bits consists of a carrier member with a supporting face which consists of two component supporting faces adjoining one another in wedge-shape forming a front edge, and applied to each of the two component supporting faces is a supporting member together with a cutting layer which occupies the whole area. The cutting member which is wedge-shaped in its contours develops high drilling performances particularly in comparatively soft ground formations and is considerably cheaper than known wedge-shaped cutting members and renders possible an extensive variability in the formation of the supporting members together with the cutting layers and their arrangement on the carrier member.

6 Claims, 11 Drawing Figures

CUTTING MEMBER FOR ROTARY DRILL BITS

The invention relates to a cutting member for rotary drill bits for deep-well drilling and to rotary drill bits incorporating such cutting members.

In cutting members of this kind found commercially (U.S.-PS No. 4,006,788), the supporting member together with its cutting layer consists of a circular small plate or a flat cylinder, and the polycrystalline synthetic diamond material forming the cutting layer is applied to the supporting member by a sintering or hot infiltration process and forms a rigid unit with this. The expensive diamond material causes by far the greatest proportion of the production costs of such diamond cutting plates. It is true that such cutting members have a number of possibilities of use on rotary drill bits for deep-well drilling, and display satisfactory drilling capacities, but the drill bits equipped with diamond cutting members in this manner are very expensive because of the high price of the diamond material. In particular, however, such cutting members have only limited suitability in comparatively soft ground formations.

Furthermore, rotary drill bits for deep-well drilling in rock and the like ground formations have been proposed (DE-OS No. 2910347), the cutting members of which each consist of a carrier portion or supporting member of hard metal or the like and a cutting portion particularly of polycrystalline synthetic diamond material disposed on this, and are formed from a sector of a sintered body surrounding the cutting portion in the form of a core with its carrier portion at least at the periphery as a sheath. In this case, the cutting members have the shape of wedge-shaped sectors which are preferably cut out of a cylinder or a polygonal straight prism with suitable wedge angles of 45°, 60° or 90° for example.

In this proposed construction, in contrast to the cutting members in the form of small plates with a diamond covering mentioned at the beginning, the cutting portion is not formed from a thin surface layer but from a corner region of augmented diamond composition. A preferred field of use for these cutting members is formed by rotary drill bits for deep-well drilling in comparatively soft ground formations, the cutting members being inserted in a base member of the drill bit in such a manner that they engage in the formation with a leading end cutting edge and detach a chip from the formation in the manner of a plough.

It is true that particularly satisfactory drilling results can be achieved in soft ground formations with cutting members constructed in this manner, but the production of the cutting members requires a high proportion of the expensive diamond material accumulated in the corner region in the finished cutting member.

It is the object of the present invention to provide an improved cutting member for rotary drill bits.

The present invention is a cutting member for rotary drill bits comprising a carrier member having a supporting face consisting of two component supporting faces adjoining one another in a wedge-shape to form a front edge, each of the two component supporting faces mounting a supporting member occupying its full area and having on its front face a cutting layer.

The present invention is also a rotary drill bit incorporating cutting members as defined in the last preceding paragraph.

In a preferred embodiment, a supporting member together with a cutting layer is disposed on each of the component supporting faces of the carrier member mating in wedge-shape, so that a cutting member which is wedge-shaped in its contours is formed which can develop a plough effect in drilling operation when working the ground formation and therefore can achieve high drilling performances particularly in comparatively soft ground formations. At the same time, the cutting member according to the preferred embodiment is considerably cheaper than the known wedge-shaped cutting members because the supporting member and cutting layer used according to the invention can be formed from the cutting members in the form of small plates or circular cylindrical shaped bodies which have long been known and are found commercially and out of which they are cut preferably in contours corresponding to the component supporting faces of the carrier member. Fundamentally, production of the supporting member together with the cutting layer is also possible as a shaped body corresponding to a predetermined component supporting face of the carrier member but the preparation from sectors from a circular cylindrical shaped body according to the component supporting faces of the carrier member offers the advantage that ordinary commercial diamond cutting plates can be used and rationally employed. In particular, an accumulation of expensive diamond material in the corner region of the cutting members is avoided and a far-reaching variability in the formation of the supporting members together with the cutting layer and their arrangement on the carrier member is ensured. In this manner, the cutting members according to the invention can be produced with a maximum of economy, to which not least the fact contributes that even unused residues of circular diamond cutting plates which have already been used can be used economically for the production of cutting members according to the invention.

Embodiments of the present invention will now be described, by way of example, with reference to the accompanying drawings, in which:

FIGS. 1*a* and 1*b* show a cross-section through a first embodiment of a cutting member according to the present invention;

Figure 1A:
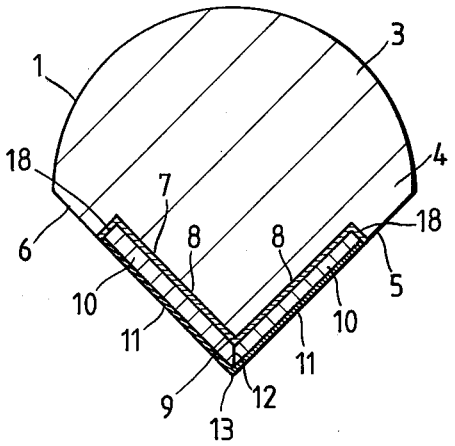

The cutting members illustrated in the figures comprise a carrier member 1 which is formed from a hard-metal or the like hard-material pin and can be inserted by one end in a base member 2, for example a matrix binding-agent composition, of a drill bit. In the embodiments shown in FIGS. 1 and 2, the carrier member 1 has, in its main portion, the cross-sectional shape which can be seen from these figures and which is composed of asemicircular area 3 and a triangular area 4. Machined in the lateral faces 5 and 6 bounding the triangular area 4 of the carrier member 1 is a supporting face 7 which consists of two component supporting faces 8. The two component supporting faces 8 meet in a wedge shape, in the example illustrated at an angle of 90°, and at their transition form a front edge 9 of the supporting face 7.

Applied to each of the two component supporting faces 8, at its back, is a supporting member 10 together with a cutting layer 11, which occupies the whole area. The supporting members 10 consist of a suitable hard metal or sintered metal or the like hard material, for example tungsten carbide, while the cutting layer 11 consists of suitable diamond material, particularly polycrystalline synthetic diamond material and is rigidly connected to the supporting member 10 by a hot infiltration process by methods known per se. The supporting member 10 together with its cutting layer 11 is cut, for example by spark erosion, out of a circular cylindrical shaped body comprising the cutting layer at one surface, which can be formed by production methods known per se. In the embodiment shown in FIG. 1*a*, the adjacent edges 12 of the supporting member 10 and cutting layer 11 are mitre-cut, mate flush with one another in front of the front edge 9 of the supporting face 7 and together form an end cutting edge 13, while in the modification shown in FIG. 1*b* the supporting member 10 and cutting layer 11 are cut at right angles forming marginal faces 12' and are secured to the carrier member overlapping in the manner shown.

Figure 1B:
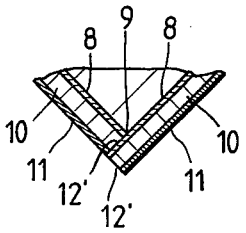
Figure 2:
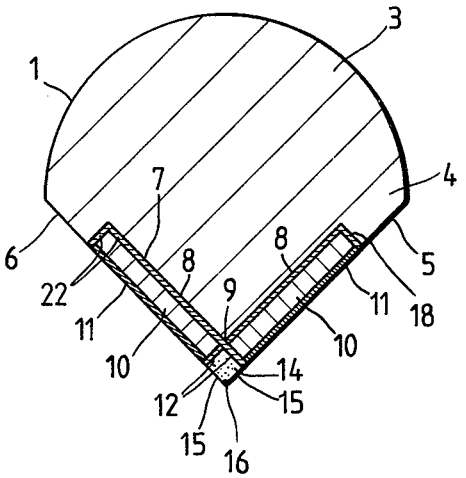
FIG. 2 shows a cross-section through a second embodiment of a cutting member according to the present invention.

The embodiment according to FIG. 2 differs from that of FIG. 1*a* in that the adjacent marginal faces 12' of the supporting member 10 together with the cutting layer 11 extend at right angles to their front and their back and a separate insert 14 of hard material is disposed in the gusset remaining between them. The insert 14 of hard material is formed from a shaped body in the form of a square rod, the lateral dimensions of which correspond substantially to the width of the supporting member 10 together with the cutting layer 11, that is to say their marginal faces 12', and the height of which corresponds substantially to that of the front edge 9 of the supporting face 7. The outer faces 15 of the insert 14 of hard material are in alignment with the cutting layer 11 of the particular adjoining supporting member 10, while its front edge 16 forms an end cutting edge corresponding to the end cutting edge 13 of the embodiment shown in FIG. 1.

Figure 3:
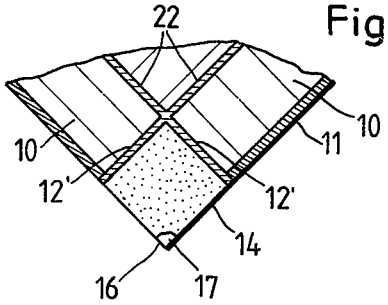
FIG. 3 shows an enlarged corner region of the cutting member of FIG. 2.

The insert 14 of hard material may consist of a hard metal or, as illustrated in the enlarged detail shown in FIG. 3, or a matrix composition which is impregnated with diamonds or comprises diamonds set in the surface. Above all, diamonds 17, preferably natural ones, are inserted in the region of the end cutting edge 16 of the insert 14.

As can further be seen from FIGS. 1 and 2, the component supporting faces 8 of the carrier member 1 are provided with marginal faces 18 which are stepped outwards and against which the supporting members 10 together with their cutting layer 11 are supported at the edge side in regions of their marginal faces 12 and 12' remote from one another. Remaining in a lateral extension of the supporting members 10 are regions of the lateral faces 5 and 6 of the carrier member 1 which continue the cutting layer 11 of the supporting members 10 in a direction facing away from the end cutting edge 13 or 16 and are in alignment with these in the embodiment illustrated. These face regions form rakes to remove the formation chips drilled out.

In FIGS. 4 to 10, the pin-shaped carrier member 1 is shown in its installed state in a drill bit, in which case it is inserted by one of its ends in the base member 2 of the drill bit and carries the two supporting members 10 together with the cutting layer 11 in its region projecting beyond the base member 2. It can be seen that the supporting members 10 together with the cutting layer 11 each have the shape of a segment or a sector of a circle, the component supporting faces 8 being constructed in the form of a divided circle accordingly. The supporting members 10 border, with a front marginal edge, which can be formed during an operation of cutting the supporting member 10 together with the cutting layer 11 out of a circular cylindrical shaped body, against the front edge 9 of the supporting face 7, while the edges 19 remote from one another of the supporting members 10 together with the cutting layer 11 are either engaged over and supported by the marginal faces 18 of the component supporting faces 8 which are bent outwards at an angle or form outer cutting edges 20 supplementing the end cutting edge 13 or 16 which is disposed in the plane of the front edge 9 of the supporting face 7 of the carrier member 1.

Figure 4:
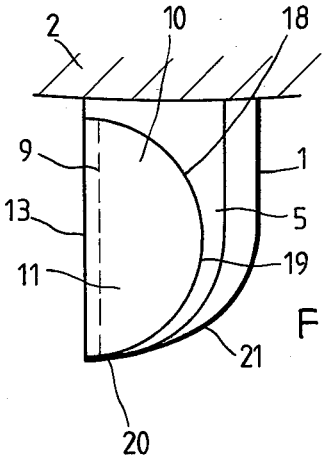
FIGS. 4 to 10 each show further embodiments of cutting members according to the present invention in side view.

In the embodiment shown in FIG. 4, the two supporting members 10 together with the cutting layer 11 each have the form of a semicircle in plan view, the straight edge forming the end cutting edge 13 while the arcuate edges 19 are mainly engaged over by the marginal face 18 of the component supporting faces 8 and only their lower end region forms an additional outer cutting edge 20.

Instead of a semicircle, other supporting members 10 together with cutting layers 11 in the form of segments of a circle may be used in arrangements corresponding to FIG. 4.

Apart from this, in the embodiment shown in FIG. 4, as in the further embodiments shown in FIGS. 5 to 8, the pin-shaped carrier member 1 is provided with an outer, free, backward end region 21 which is rounded in arcuate shape towards the front edge 9 of the supporting face 7 or towards the end cutting edge 13 or 16.

Figure 5:
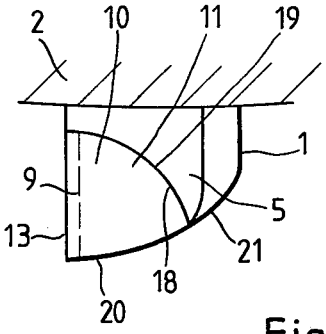

In the embodiment shown in FIG. 5, the two supporting members 10 together with the cutting layers 11 each have the basic shape of a sector of a circle in plan view, one straight edge forming the end cutting edge 13 and the other sector edge kept free of support by the carrier member 1 is in turn rounded in continuation of the arcuately rounded region 21 of the carrier member 1 towards the end cutting edge 13. The arcuate edge of the two supporting members 10 together with the cutting layers 11 is engaged over and supported by the angled marginal faces 18 of the component supporting faces 8.

Figure 6:
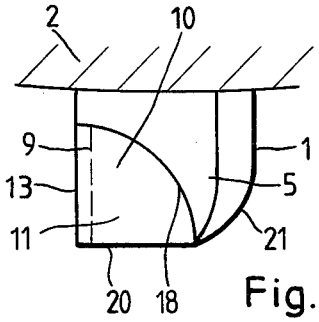

The embodiment shown in FIG. 6 differs from that of FIG. 5 essentially in that the outer cutting edge 20 of the supporting members together with the cutting layers 11, which are also in the form of a sector of a circle here, extends straight and at right angles to the end cutting edge 13.

Figure 7:
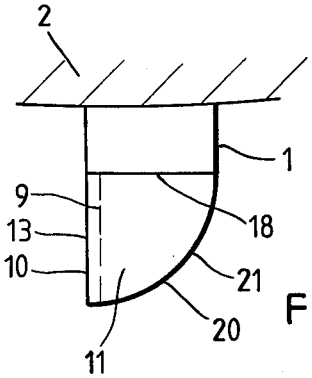

In the embodiment shown in FIG. 7, in which the two supporting members 10 together with the cutting layers 11, as in the case of the embodiment shown in FIG. 6, are each formed from a sector of a circle in the form of a quadrant, a modification is made in such a manner that the one straight sector edge forms the end cutting edge 13 and the arcuate marginal edge forms the additional outer cutting edge 20, while the other straight sector edge is engaged over and supported by one of the angled marginal faces 18 of the two component supporting faces 7. The rear, rounded outer region 21 of the carrier member 1 extends congruent with the outer cutting edge 20 of the supporting member 10 together with the cutting layer 11.

Figure 8:
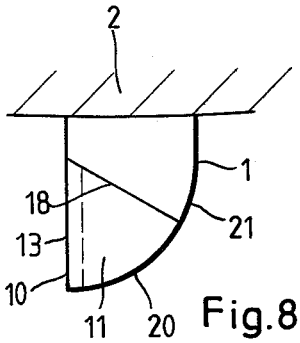

In the embodiment shown in FIG. 8, the two supporting members 10 together with the cutting layers 11 are provided in the form of acute-angled sectors of a circle in an arrangement corresponding to FIG. 7. While the one straight sector edge again forms the end cutting edge 13 and the arcuate edge forms the additional outer cutting edge 20, the other straight marginal edge, engaged over by one of the angled marginal faces 18 of the component support faces 8, extends obliquely to the end cutting edge 13 according to the angle selected. The rear, rounded outer region 21 of the carrier member 1 assumes a course corresponding to the example shown in FIG. 7.

Figure 9:
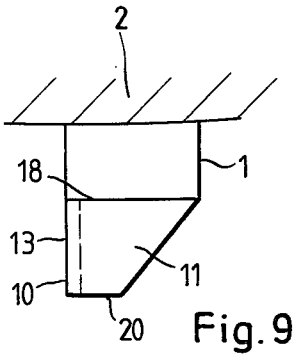
Figure 10:
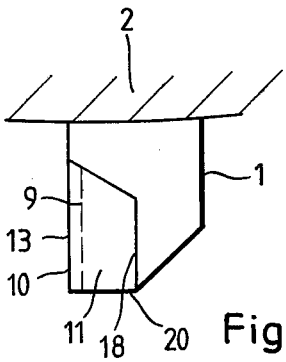

In the embodiments of FIGS. 9 and 10, the supporting members 10 together with the cutting layers 11 are not formed by sectors of a circle but only have straight boundary edges. In these cases, the supporting members 10 together with the cutting layers 11 may likewise be formed by being cut out of appropriate shaped bodies or may be constructed in the form of shaped bodies preshaped in their final form.

In the embodiments shown in FIGS. 9 and 10, the arrangement and mounting of the supporting members 10 together with the cutting layers 11 on the carrier member is effected as in the examples described above. Thus in the embodiment shown in FIG. 9 there is a lower outer cutting edge 20 corresponding to FIG. 6, which extends straight and at right angles to the end cutting edge 13. The straight marginal edge situated opposite to the outer cutting edge 20 and extending parallel to this is engaged over and supported by an angled marginal face 18 of the associated component supporting face. Between these two marginal edges, a straight marginal edge of the supporting member 10 together with the cutting layer 11, which edge is kept free of support, extends obliquely to the base member 2.

In the embodiment shown in FIG. 10, a lower outer cutting edge 20 which extends straight and at right angles to the end cutting edge 13 is likewise provided, and the straight marginal edges engaged over by the angled marginal faces 18 of the component supporting faces 8 extend at first at right angles to the lower outer cutting edge 20 and then extend obliquely to the outer cutting edge 13 and to the base member 2.

Lateral face regions 5 and 6 in an extension of the cutting layers 11 of the two supporting members 10 are omitted in the embodiments shown in FIGS. 7, 8 and 9.

The rigid connection of the two supporting members 10 to the carrier member 1 can be effected by a soldered connection 22, as illustrated diagrammatically in FIGS. 1 to 3. In the case of the embodiment shown in FIGS. 2 and 3, the connection of the insert 14 of hard material to the supporting members 10 can also be effected by the soldered connection 22.

Instead of a soldered connection, the two supporting members 10 can be connected to the carrier member 1 and possibly the insert 14 of hard material may be connected to the two supporting members 10 by form sintering or hot isostatic pressing.

The examples illustrated in the drawings are only a selection from a large number of possible forms of the cutting members and their mounting on the drill bit, and various setting angles may be selected with regard to the ground formation to be worked, so that the cutting members can act on the formation not only with a ploughing action with a leading end cutting edge 13 or 16, but also with a scratching or scraping action.

The embodiments of the invention in which an exclusive property or privilege is claimed are defined as follows:

1. A cutting member for rotary drill bits comprising a carrier member having a supporting face consisting of two component supporting faces adjoining one another in a wedge-shaped to form a front edge, each of the two component supporting faces mounting a supporting member occupying its full area and having on its front face a polycrystalline diamond cutting layer, and wherein the adjacent edges of the supporting members have marginal faces extending at right angles to their front and their back and a separate insert of hard material is disposed in a gusset remaining between these.

2. A cutting member as claimed in claim 1, in which the insert of hard material is formed from a shaped body in the form of a square bar the lateral dimensions of which correspond to the width of the supporting members together with the cutting layer and the height of which corresponds to that of the front edge of the supporting face.

3. A cutting member as claimed in claim 2, in which the insert of hard material consists of a matrix composition which comprises diamonds set in the surface.

4. A cutting member as claimed in claim 3, in which the carrier member is formed from a pin of hard material which can be inserted by one end in a base member of a drill bit and which carries the two supporting members together with the cutting layer in its region projecting beyond the base member.

5. A cutting member as claimed in claim 4, in which the component supporting faces of the carrier member are provided with marginal faces stepped outwards at an angle against which the supporting members together with their cutting layer are supported at the edge side in the regions of their edges remote from one another.

6. A cutting member as claimed in claim 5, in which the carrier member has surface regions which are disposed in lateral extension of the supporting members and which continue the cutting layer of the supporting members.

* * * * *